United States Patent [19]

Speshyock

[11] 4,231,364

[45] Nov. 4, 1980

[54] RESPIRATORY CONTROL

[76] Inventor: Fred R. Speshyock, 33091-R Calle Perfecto, San Juan Capistrano, Calif. 92675

[21] Appl. No.: 34,649

[22] Filed: Apr. 30, 1979

[51] Int. Cl.[3] ..... A62B 7/10

[52] U.S. Cl. ..... 128/206.15; 128/207.14; 128/136

[58] Field of Search ..... 128/206.15, 206.12, 128/205.29, 206.27, 204.13, 207.16, 207.14, 206.21, 200.24, 202.13, 205.24, 205.25, 206.27; 272/99

[56] References Cited

U.S. PATENT DOCUMENTS

| | | | |
|---|---|---|---|
| 2,039,142 | 4/1936 | Brehm | 128/207.16 X |
| 3,731,678 | 5/1973 | Pyzel | 128/205.27 X |
| 3,908,665 | 9/1975 | Moses | 128/207.14 |
| 4,054,134 | 10/1977 | Kritzer | 272/99 R X |
| 4,141,703 | 2/1979 | Mulchi | 128/206.15 X |

*Primary Examiner*—Henry J. Recla

*Attorney, Agent, or Firm*—Joseph R. Dwyer

[57] ABSTRACT

A respiratory control comprising a mouthpiece of a shape and size for insertion in a person's mouth having a centrally located filtering cartridge and valve means to control the flow of air past the filtering material on inhale and out a separate exhale corridor on exhale so that the exhaled bacterial, virus or otherwise contaminated air is never mixed with the filtered and enhanced air and the filter is kept clean of contaminated air at all times. Thus, the inhalation of infectious substances of whatever type exhaled, or in the immediate area, are not recycled back into the body.

The filtering cartridge is a removable throwaway insert which can be simply plain, (dry), or medicated and can be made available as a sealed package purchasable separately from the mouthpiece and disposed after use.

In one embodiment the valve means is part of the filtering cartridge and in a second embodiment the valve means is part of the mouthpiece.

18 Claims, 10 Drawing Figures

RESPIRATORY CONTROL

BACKGROUND OF THE INVENTION

This invention relates, in general, to the relief of breathing problems and, in particular, to a new and improved respirator control suitable for insertion in a person's mouth to provide filtered air and controlled breathing.

People who have difficulty in breathing, whether due to nasal congestion, the common cold, allergies, sinus congestion or smog, or the like, or who have difficulty sleeping because of throat dryness, usually depend upon currently available items, such as, throat lozenges, cough drops, nasal inhalers, and the like, all of which meet with limited success in relieving the congestion and other respiratory problems.

In the market today, there exists a need for a respiratory control which can be used, either at home, office, or in the hospital or on the street, for relief of respiratory problems by making filtered, plain, moisterized, or medicated, or otherwise inhaled air, available in a simple, inexpensive and expeditious manner.

Accordingly, it is an object of this invention to provide a respiratory control for the relief of respiratory problems which is inexpensive, readily available, and which can provide filtered, plain, moisterized, and/or medicated or otherwise enhanced, air easily and simply.

SUMMARY AND ADDITIONAL OBJECTS AND ADVANTAGES OF THE INVENTION

The respiratory control which meets the foregoing object comprises a mouthpiece of a size and shape for insertion in a person's mouth having a centrally located filtering cartridge and valve means which control the flow of air so that a person inhales filtered air in one air inhale corridor and exhales contaminated air through a separate exhale corridor. The valve means controls the inhale flow of air past the filtering material and out the separate exhale corridor so that inhaled filtered air is never mixed in the mouthpiece with the exhaled contaminated air and thus the filter is kept clean and clear of contaminated air at all times. Also, the inhalation of bacteria, mucus or any infectious substances secreted from infected lungs, sinuses or other organisms that remain in the atmosphere immediately about the head, are not recycled (again inhaled) back into the body.

In a first embodiment of the invention, the valve means forms part of the filtering cartridge and in a second embodiment the valve means forms part of the mouthpiece.

The filtering cartridge can be a removable throw-away insert containing filtering material which can be simply plain, (dry), moistened or medicated depending upon the person's needs and can be made available as a sealed package, purchasable separately from the mouthpiece, and disposed after use.

Accordingly, it is an additional object of this invention to provide a respiratory control with a valve control for filtering means which keeps the filtering means free of contaminated exhaled air.

A more specific object of this invention is to provide a respiratory control with a valve control with a locking action wherein one valve is activated into an open position while the other is being pushed into a locked position and visa versa on inhale and exhale.

It is still another object of this invention to provide a removable filter cartridge for a mouthpiece which is available separately with a filter which is plain for filtered air, moistened for oxygen enriched filtered air, or containing medication for medically enhanced filtered air.

Still another object of this invention is to provide a respiratory control of a suitable plastic material which is inexpensive, yet sterilizable and which may be used in the home, in the hospital, in smoggy areas or wherever respiratory control is needed.

This invention will be better understood as well as further objects and advantages thereof will become more apparent from the ensuing detailed description of two embodiments taken in conjunction with the drawings.

BRIEF DESCRIPTION OF THE PREFERRED EMBODIMENTS

Figures 1, 2, 6:
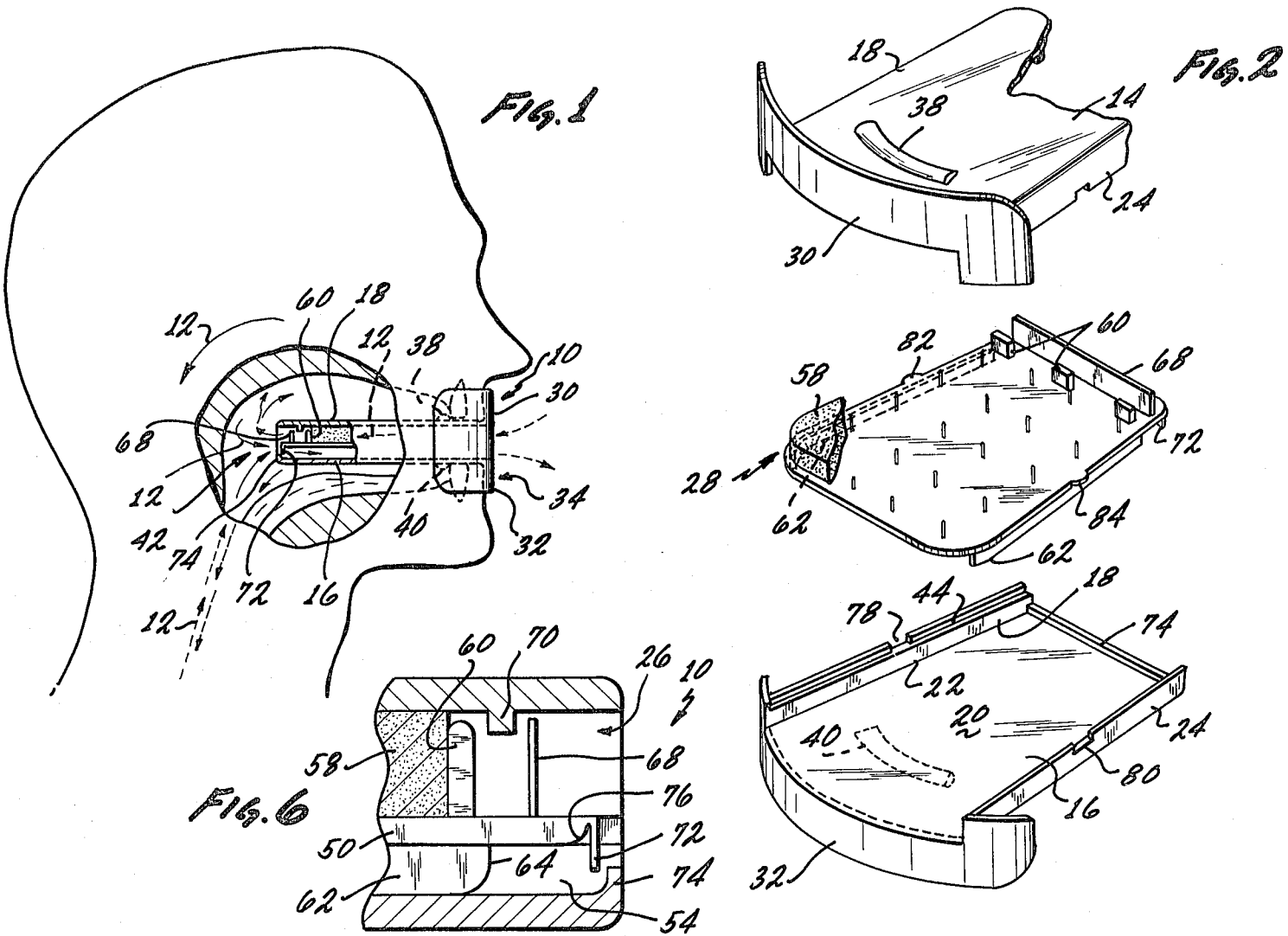
FIG. 1 illustrates the use of the respirator control constructed in accordance with the teachings of this invention.
FIG. 2 is an exploded view partially broken away to illustrate the various parts of the respirator control.
FIG. 6 is an enlarged view of a portion of FIG. 4 to show the valve means in more detail.

Turning first to FIG. 1, there is shown an outline view of a person's head with the first embodiment of a respirator control 10 shown inserted in the mouth cavity for controlled breathing. The arrows 12 indicate the flow of the air when inhaled and exhaled. These arrows also show, in a general way, the flow of air in the sinuses and throat and in and out the control 10.

Turning now to FIGS. 2–6, and first to FIG. 2, it can be seen that the respirator control 10 comprises upper and lower envelope pieces 14 and 16 with relatively flat walls 18 and 20 and complimentary side walls 22 and 24. These envelope pieces, when brought together, define a mouthpiece with an internal cavity 26 (FIGS. 3–6) in which is inserted a removable filtering cartridge or throw-away insert 28. Each envelope piece is also provided with complimentary curved walls 30 and 31 which define a safety shield 34 and lip or mouth opening 36 when the two envelopes are brought together to define the cavity 26. This safety shield 34 is contoured to overlap the lips of a person's mouth by a large margin so that the mouthpiece cannot be swallowed yet avoids interference with the nose and is preferably without connection points which would enable straps or other holding means to be attached to the safety shield to be used to hold the mouthpiece in the mouth. This latter is important so as to enable the mouthpiece to be coughed out in any event of choking, vomiting, or the like. Also, spaced a slight distance from the safety shield, are a pair of ridges 38 and 40 located on the outside surfaces of the walls 18 and 20 and which together form a teeth grip ledge for the user's teeth as shown in FIG. 1 to aid in holding the mouthpiece in the mouth cavity.

From the safety shield 34, the envelope pieces taper to give the cavity 26 a taper so that the throat opening 42 is smaller than the lip opening 36. The side walls 22 and 24 are also provided with mating offset edges (only one being shown at 44 in FIG. 2) to provide elongated grooves 46 and 48 in FIG. 5 on each side facing cavity 26 into which the edges of a base 50 of the filtering cartridge 28 may be inserted to divide the inner cavity 26 into two air corridors 52 and 54. The upper corridor 52 is the inhale corridor and the lower corridor 54 is the exhale corridor; the inhale corridor 52 may be larger to compensate for the loss of air pressure through the filter material.

Turning now specifically to the removable cartridge 28, it can be seen from the review of the drawings that the base 50 is relatively flat and tapered so as to nest in the cavity 26 and slideably fit into the groove 46 and 48. The base 50 is provided on one surface with a plurality of pinlike projections or spikes 56 which serve to hold the filtering material 58 thereon during packaging, transportation, and to hold the material within the cartridge during insertion into the mouthpiece. The filtering material can comprise gauze, cotton, or the like, conventionally used for a filtering material and which can be moistened, provided with medication, or simply dry for filtering air in the upper inhale corridor 52. This same side of base 50 is also provided with stop means in the form of upwardly extending posts 60 which locate the filtering material 58 and prevent its forward movement towards the throat opening 42.

On the bottom side of the base 50, there is provided a plurality of ribs or runners 62 (two shown) running generally in the direction of the air flow in the mouthpiece with curved ends 64 located near the forward end of the bottom wall. The purpose of these runners is to guide the base 50 into the grooves 44 and 46 and the curved ends 64 aid in the insertion of the cartridge because the filtering material may be slightly thicker than the space between the grooves 44 and 46 and the inside of the envelope wall 18. The curved surface 64 permits a slight tilting of the cartridge as it is being inserted through the opening 36.

Figure 3:
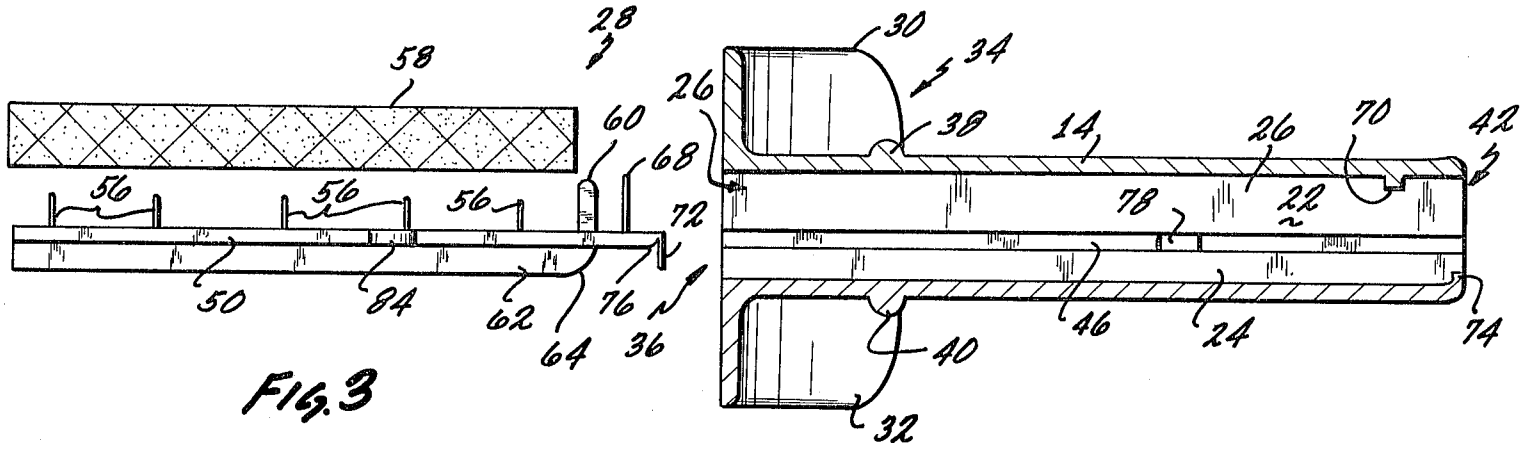
FIG. 3 shows the mouthpiece with the cartridge removed and the filtering material apart from the cartridge to show the construction thereof.
Figure 5:
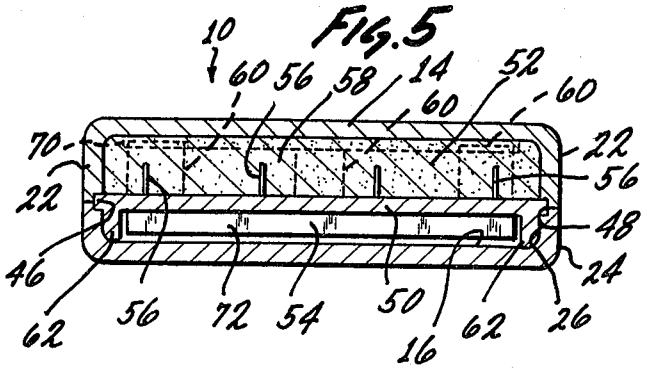
FIG. 5 is a cross-sectional view taken along line 5—5 of FIG. 4 and looking in the direction of the arrows.
Figure 4:
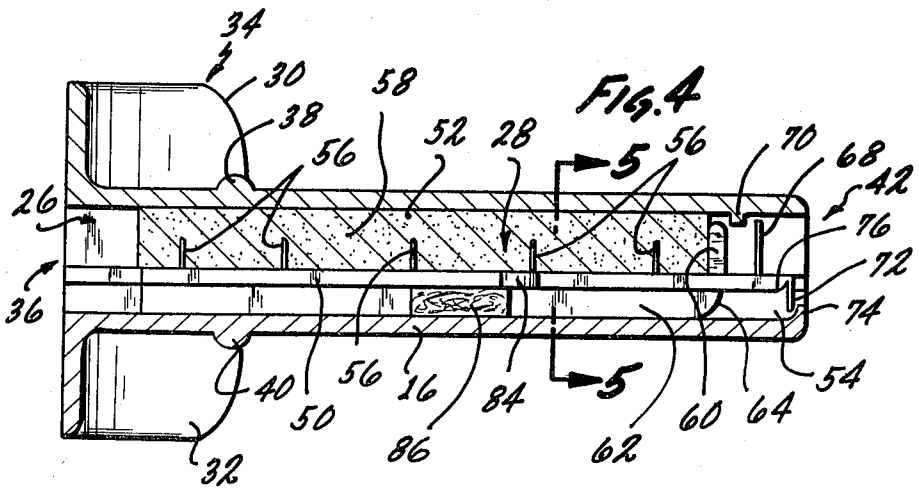
FIG. 4 is a cross-sectional view of the mouthpiece with the cartridge in place.

As shown in FIG. 2, and in FIGS. 3, 4 and 6, one side of the base 50, i.e., the filter side, is also provided with a relatively thin flat upright wall flap valve 68 extending in the direction of the upper envelope piece 14 across the width of the base 50, and located on the throat side of the post 60, opposite the filter 58. When inserted in the mouthpiece, this flap valve 68 cooperates with an inwardly extending ridge 70 on the inside of the upper envelope wall 18 and spaced from the flap valve to act as a one-way valve. The ridge 70, being relatively thick, acts as a shut-off land for the flap valve 68. The flap valve 68, being relatively thin, easily passes under the ridge 70 when the cartridge is being inserted into the mouthpiece.

On the very end of the base 50 on the side opposite the inhale flap valve 68, there is also provided a relatively thin wall flap valve 72 extending the width of the base 42 which also engages an upwardly extending ridge 74 on the lower envelope wall 20 located at the very end of or near the exit or throat opening 42 and spaced from the flap valve act as a one-way valve. This ridge 74, being located on the other side of the valve 72 as compared to the inhale flap valve 68 and its land 70, acts as a shut-off land for the flap valve 72 for air moving in the opposite direction to the flow of air in the inhale corridor. Note that a clearance 76 is provided at the junction of the wall 72 and base 50 to give the flap valve 72 more freedom of movement since its extension in the direction of the lower envelope is much less than the extension of the inhale flap valve 68. This shortness of the exhale valve tends to make the material less resilient.

To lock the filtering cartridge in the mouthpiece, the side walls 20 and 22 of the envelopes are provided with slots or openings 78 and 80 (½ of each of the openings formed in the upper and lower envelope pieces), into which suitable projections or bosses 82 and 84 formed on the sidewalls of the base 50 are inserted. Because of the resilient nature of the material utilized, in this case polypropolene, the filtering cartridge can be easily inserted and removed from the mouthpiece, although a slight force, such as provided by a finger might be inserted into the throat opening 38 might be necessary to cause the bosses to disengage from the openings.

Finally, as an optional feature, an additional filter, such as 86, may be provided in the exhale corridor 54 to act as a trap to catch mucus if desired. This filter can be held in place by any suitable means such as by adding additional spikes on the bottom of the wall 50.

The foregoing shows that there are additional advantages which acrue. For example, while the base 50 is made of polypropolene, a plastic which is sterilizable, as by boiling, and with sufficient body to support the posts 60 and the valves 68 and 72, the envelope can be preferably made out of methylpentene, which is resistant to acids, is sterilizable by boiling, and provides a better welding material for ultra sonic welding. The latter, by the way, is preferable since there are no solvents or additives which might react with the medication and, the material being clear, permits a visual inspection of the flap valves and assumes the color of the face when the safety shield 34 is against the skin surrounding the mouth.

Another advantage of this respiratory control involves epileptics. Epileptics, when in their loss of control, are endangered further by a swallowing of the tongue, so they generally have a large gauze ball inserted in their throat to prevent that occurrence. This method impedes breathing and can choke the patient if a nasal block exists. In this instance, the respiratory control can function to hold the tongue, give free breathing and can be medicated, if necessary. Insertion can be made by the epileptic when an attack is imminent.

Another advantage in this respiratory control is that the flap valve 72, the exhale one-way valve, can be made in various thicknesses to force exhale breathing as a means for exercising the lungs. Thus, the thickness of the flap valve 72 can be selected and prescribed by a doctor for a patient having emphysema to force the patient to exercise the lungs by starting, for example, with a relatively thin valve and gradually increasing to a rather thick valve. This gradual increase in thickness forces the exercise of the lungs.

Figures 7, 8, 9, 10:
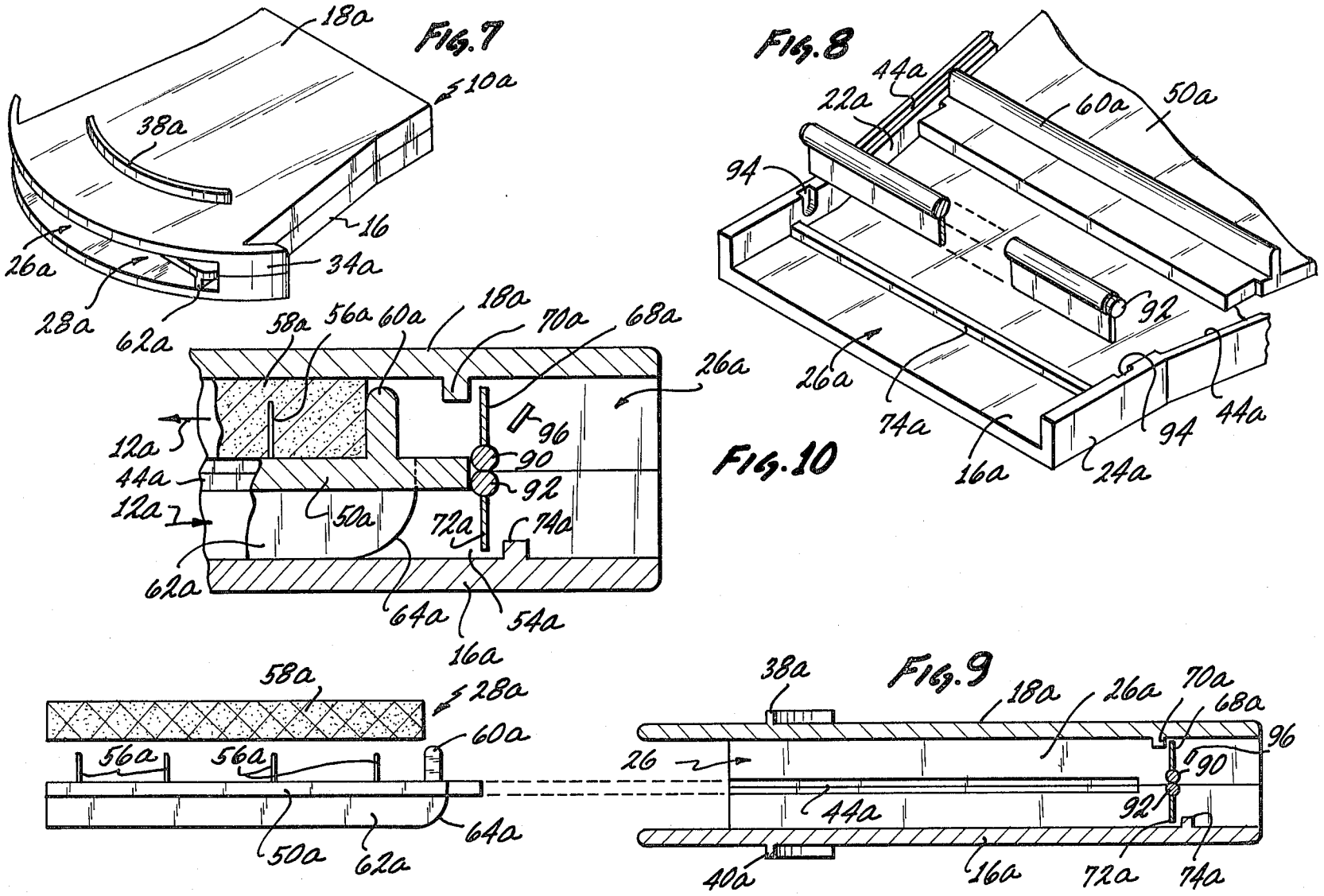
FIG. 7 is a perspective view of a second embodiment of the respirator control.
FIG. 8 is a partial perspective view enlarged over the view in FIG. 7 and shown partially assembled to illustrate the valve means of this embodiment.
FIG. 9 is a cross-sectional view of the cartridge and mouthpiece to illustrate their relationship.
FIG. 10 is an enlarged view of a portion of the respirator control to further illustrate the cartridge and valve means.

Turn now to FIGS. 7–10 which illustrate the second embodiment of the invention. For simplicity, those elements performing the same function in this embodiment are given the same reference numeral with the addition of the suffix a. Thus, in general, the mouthpiece of this embodiment is formed in two envelope pieces 14*a* and 16*a* and is provided with a removable filtering cartridge 28*a*. In this embodiment, however, the flap valves 68*a* and 72*a* do not form part of the filter cartridge but are part of the mouthpiece. Each valve has an integral pivot rod 90 and 92, circular in cross section, which extends beyond the thin walls of the valves 68*a* and 72*a*, to seat and pivot in matching slots 94 on each edge of the side walls 22*a* and 24*a* (only the slots in the side walls of the envelope 16*a* being shown). The valves are held in place in these matching slots 94 as shown in FIGS. 9 and 10 and engage shut-off lands 70*a* and 74*a* during inhale and exhale. It is to be noted also, that in this embodiment, the grooves 44*a* and base 50*a* do not extend the full length of the envelopes to accommodate the matching slots 94 and to permit freedom of movement of the valves by having the sidewalls 22*a* and 24*a* in parallel near the throat end of the mouthpiece. Also, it is to be noted that the valve shut-off land 74*a* is located inwardly of the throat end as contrasted to the location of the shut-off valve 74 depicted in FIG. 6. Further, to prevent the inhale valve 68*a* from tilting too far in the direction of the throat end, a stop means in the form of an inwardly extending lug 96 is provided in the side wall 24*a*. Thus, the inhale valve has a pivotal movement which is limited but still sufficient not to interfere with its function.

Finally, in this embodiment, it is pointed out that the inhale corridor 52*a* and exhale corridor 54*a* are equal in area and thus the filtering material 58*a* is thinner than the filtering material 58.

Also, from the foregoing it can be seen that the filter cartridges 58 and 58*a* being provided with filtering material, can be assembled separately and purchased as a sealed package containing medication for the relief of nasal congestion and the like, or may be assembled and purchased free of medication, so that the filtering material may be used either dry, or moistened, for filtered air breathing. The filtered air, or medicated filtered air, can provide relief, or a decrease in cure time, from many breathing difficulties, sicknesses, the common cold, sinus, asthma, bronchitis, emphysema, smog irritation, etc, and with the addition of water in the filter, can preclude dry mouth and other discomforts and can increase the oxygen intake for a decrease in breathing rate.

What is claimed is:

1. A respiratory control for use in the mouth cavity for controlled breathing comprising, means defining a mouthpiece adapted to be inserted inside the mouth cavity and having a bore extending therethrough with first and second open ends, said bore being tapered from said first open end to said second open end, said first open end adapted to be located near the entrance to the mouth cavity and said second open end being adapted to be located in the back or throat portion of the mouth cavity, means defining first and second air corridors between said first and second open ends, said first corridor for the flow of air during inhalation and said second corridor for the flow of air during exhalation, valve means in said bore permitting the flow of air in said first corridor only from said first open end to said second open end and permitting the flow of air in said second corridor only from said second end to said first end, and filtering means in said first corridor for providing filtered and enhanced air to the mouth cavity.

2. The respiratory control as claimed in claim 1 wherein said means defining said mouthpiece is provided with a safety shield outwardly of said first open end which engages the lips and area surrounding the mouth to prevent swallowing of the respiratory control.

3. The respiratory control as claimed in claim 2 further including teeth gripping means spaced from said safety shield.

4. The respiratory control as claimed in claim 3 wherein said means for dividing said cavity into corridors and said filter define a replaceable cartridge for the mouthpiece.

5. The respiratory control as claimed in claim 4 wherein said valve means comprises a ridge extending inwardly of said bore and transversely in each respective corridor which define shut-off valve lands for said valve means and relatively thin oppositely directed walls extending into each corridor from said cartridge towards said ridges, said walls being disposed with respect to said ridges thereby cooperating with said ridges to define a pair of one-way valves which operate in opposite directions during inhalation and exhalation.

6. The respiratory control as claimed in claim 4 wherein said valve means comprises a ridge extending inwardly of said bore and transversely in each respective corridor which define shut-off valve lands for said valve means and relatively thin oppositely directed walls mounted in said bore and extending into each corridor towards said ridges, said walls being disposed with respect to said ridges thereby cooperating with said ridges to define a pair of one-way valves which operate in opposite directions during inhalation and exhalation.

7. The respiratory control as claimed in claim 6 wherein said cartridge is provided with means for preventing movement of the filtering material.

8. The respiratory control as claimed in claim 7 wherein said means for preventing movement of said filtering material comprises spikes which interface with said filtering material.

9. The respiratory control as claimed in claim 8 wherein said means for preventing movement of said filtering material comprises posts on said cartridge for preventing movement of said filtering material towards the throat area.

10. The respiratory control as claimed in claim 9 wherein said cartridge has ribs extending the length thereof for spacing said cartridge in said bore and means associated with said bore for aiding in the insertion of the cartridge into the bore.

11. The respiratory control as claimed in claim 10 wherein said cartridge is provided with locking means which engage in cooperating locking means in said bore for locking said cartridge within the bore.

12. The respiratory control as claimed in claim 11 wherein said valve means is used to control the inhaled or exhaled pressure required to open said valve means into either corridor to exercise a person's lungs.

13. The respiratory control as claimed in claim 12 further and including additional filtering means in the exhaled corridor for trapping mucus and the like exhaled from a person.

14. A respiratory control comprising,